United States Patent [19]

Seris

[11] 3,981,692

[45] Sept. 21, 1976

[54] COMBUSTIBLE MIXTURE FOR TORCHES AND BURNERS

[75] Inventor: Georges Séris, Antony, France

[73] Assignee: L'Air Liquide, Societe Anonyme pour l'Etude et l'Exploitation des Procedes Georges Claude, Paris, France

[22] Filed: Feb. 27, 1974

[21] Appl. No.: 446,326

Related U.S. Application Data

[63] Continuation-in-part of Ser. No. 94,207, Nov. 20, 1970, abandoned.

[30] Foreign Application Priority Data

Nov. 29, 1969 France ..... 69.40730

[52] U.S. Cl. ..... 48/197 FM; 44/52; 48/196 FM; 48/199 FM; 148/9 R; 252/372

[51] Int. Cl.[2] ..... B23K 7/00; C10L 3/00

[58] Field of Search. 48/196 FM, 197 FM, 199 FM; 44/52; 252/372; 148/9

[56] References Cited

UNITED STATES PATENTS

| | | | |
|---|---|---|---|
| 3,226,213 | 12/1965 | Nelson et al. | 48/197 FM |
| 3,352,652 | 11/1967 | Belfit | 48/197 FM |
| 3,355,331 | 11/1967 | Johnson | 48/197 FM |
| 3,706,542 | 12/1972 | Gilks | 48/197 FM |

*Primary Examiner*—S. Leon Bashore
*Assistant Examiner*—George C. Yeung
*Attorney, Agent, or Firm*—Browdy and Neimark

[57] ABSTRACT

A combustible mixture for torches and burners is formed essentially of at least 15% of a member of the group consisting of methylacetylene and/or propadiene diluted with up to 85% of a diluent which itself is formed of a mixture of at least one $C_3$ hydrocarbon and at least one $C_4$ hydrocarbon, and in addition wherein the $C_3$ diluent comprises at least about 45% of all the $C_3$ hydrocarbons including the $C_3$ acetylenes, such that the endothermic heat of formation of the mixture for a molar volume is at least 10 KCal and that the proportion between the $C_3$ and $C_4$ hydrocarbons in the diluent is between 70/30 and 95/5.

12 Claims, 1 Drawing Figure

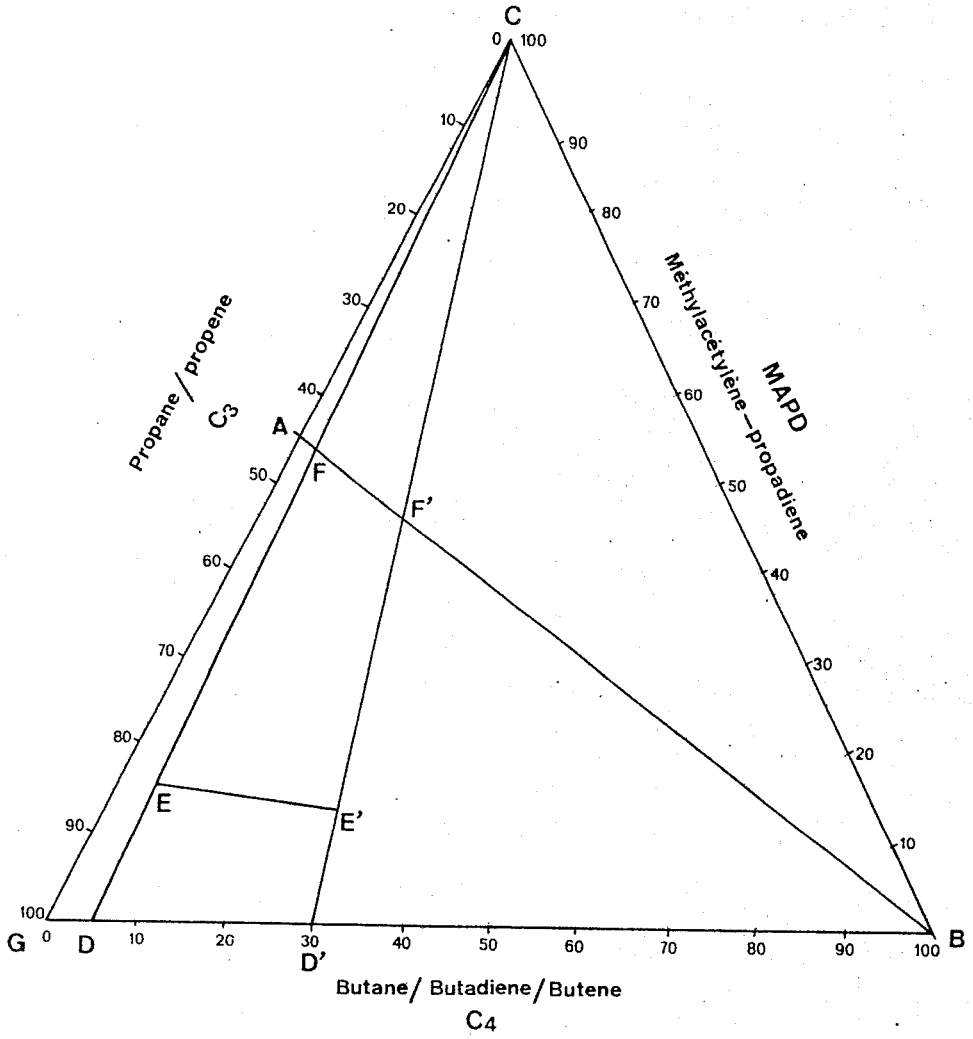
C
0
100
10
20
30
40
50
60
70
80
90
100
90
80
70
60
50
40
30
20
10
Propane / propene
C3
Méthylacétylène–propadiene
MAPD
A
F
F'
E
E'
G
D
D'
B
0
10
20
30
40
50
60
70
80
90
100
Butane / Butadiene / Butene
C4

COMBUSTIBLE MIXTURE FOR TORCHES AND BURNERS

This is a application of Ser. No. 94,207, granted the official filing date of Nov. 20, 1970, now abandoned.

In torches or burners which are used for welding, oxygen cutting or hardening, it has been customary for more than fifty years to use acetylene. This gas owes its heating qualities in a large degree to its great endothermic heat of formation; it was in fact established that the classification order of the different hydrocarbons, tested as fuels in the torches, is the same whether they are classified according to their heating quality or according to the value of their heat of formation.

Therefore, it naturally came to mind to use methylacetylene or propadiene, or mixtures of these two substances, for the industrial operations which are referred to above, these gases having endothermic heat of formation values close to that of acetylene.

However, substances having a high endothermic heat of formation are frequently unstable; this is the case with acetylene, methylacetylene and propadiene. It is therefore dangerous to store these gases in the liquefied state in bottles.

The stored product is stabilized by dilution of these substances with stable liquids or liquefied gases, in the way which has already long been proposed with respect to acetylene (dissolution in acetone or dilution in ammonia). Methylacetylene or propadiene is also stabilized by dilution with stable hydrocarbons, such as propane, propylene, butane, butylene, etc.

Although stable liquefied mixtures are obtained in this way, the overall endothermic heat of formation of these mixtures is smaller than that of pure propadiene or methylacetylene. This lesser endothermic heat of formation is harmful to the heating quality of the mixture; consequently, it is desirable not to dilute the methylacetylene or the propadiene too much, so as to preserve a heat of formation of the mixture close to that corresponding to the limit of stability, this being a heat of the order of 30 KCal for a molar volume of the gaseous mixture.

Mixtures of which the endothermic heat of formation would be smaller than 10 KCal for the gaseous molar volume would clearly be of lesser interest for the industrial applications referred to above and would come too close to the qualities of the diluent for being distinguished therefrom for practical purposes. For the final mixture to have an endothermic heat of formation of at least 10KCal per molar volume, it is necesssary to adjust the composition of the mixture with regards ethylenic, diethylenic, or acetylenic saturated compounds, bearing in mind the heat of formation of each of them.

In order to have good flame qualities, it is preferable for the choice of the nature and proportions of ethylenic, diethylenic and acetylenic saturated constituents to be such that the mixture has a total endothermic heat of formation, per molar volume, at least equal to 20 KCal, but in any event not below 10 KCal.

On the other hand, in installations for the separation of hydrocarbons intended for the production of methylacetylene or propadiene or their mixture, in order to eliminate any danger of explosion, it is necessary for the liquid phase, at each plate of the distillation columns, not to contain these substances in contents such that the stabilization threshold is exceeded; a consequence of this essential safety condition is that the products obtained must contain, as well as methylacetylene and propadiene, at least 40% of diluent $C_3$ hydrocarbons (propane, propylene or a mixture of these two compounds).

To achieve the desired stable mixtures in accordance with this invention based on the use of methylacetylene and/or propadiene and containing diluents such as propane, propene, butane, butene, etc. industrial use is made of mixtures of the $C_3$ hydrocarbons previously obtained by distillation in steamcracking units or acetylene synthesis by the cracking of heavy hydrocarbons, to which $C_4$ hydrocarbons such as butane and butene are then added. To increase the manufacturing safety of $C_3$ hydrocarbon mixtures containing methylacetylene and/or propadiene in distillation columns wherein these products are separated, and in intermediate storage tanks, the combustible mixture of all the $C_3$ hydrocarbons including both the acetylenic hydrocarbons and the diluents must contain at least 45% propane and/or propene, and preferably 50%, with the remainder being the methylacetylene and/or propadiene. By adding $C_4$ hydrocarbon to such mixture of $C_3$ hydrocarbons, the stable mixture of hydrocarbons, which includes at least 15% methylacetylene and/or propadiene, of the present invention will be achieved.

When the methylacetylene and/or propadiene, diluted with stable hydrocarbons, is stored in a bottle, it is desirable that the emptying of the bottle permit the gas to be drawn off at a substantially constant heating quality. To achieve this and to store a liquid which is always stable, it is necessary that the gaseous phase and the liquid phase maintain the total contents of diluents at substantially constant values during the emptying operation. Since there are no stable hydrocarbons having the same vapor tensions as methylacetylene or propadiene, it is necessary to use two varieties of stable hydrocarbons as diluents, one of such varieties having a vapor tension greater than that of methylacetylene and propadiene, and the other having a vapor tension which is smaller. The first such variety formed by the $C_3$ hydrocarbons (propane or propene) and the second by the $C_4$ hydrocarbons (butane, butene, butadiene, butyne). The proportion of these varieties of hydrocarbons must be within the following limits:

$$\frac{70}{30} < \frac{\text{Content of } C_3 \text{ diluents}}{\text{Content of } C_4 \text{ diluents}} < \frac{95}{5}$$

so that, during the emptying operation, a large part of the $C_3$ hydrocarbon leaves with a large part of the methylacetylene and propadiene, and then finally the remainder of the $C_3$ and most of the $C_4$ hydrocarbons leave with the end of the methylacetylene and propadiene.

Under these conditions, the gases and the liquid will always have, during the emptying, a substantially constant proportion between methylacetylene and propadiene, on the one hand, and $C_3$ and $C_4$ hydrocarbons, on the other hand.

The actual quantities of each of the ingredients can vary within relatively wide limits so long as the relative proportions fall within the ranges set forth. Thus, it is essential that (1) there be at least 15% acetylenic hydrocarbon; (2) the ratio of $C_3$ hydrocarbon diluent to acetylenic hydrocarbon be at least about 45:55; (3) the ratio of $C_3$ hydrocarbon diluent to $C_4$ hydrocarbon diluent be from 70:30 to 95:5; and (4) the molar endothermic heat of formation be at least 10 KCal and preferably about 20 KCal.

Once the above criteria have been met, the actual proportions of each ingredient may be varied considerably. However, within the above criteria, it is preferred that the composition comprise by volume 20 – 46% acetylenic hydrocarbon, 0 – 11% propane, 39 – 58% propylene, 0 – 6% butane, 0 – 7% butene and 0 – 9% butadiene, the total of $C_4$ hydrocarbons being at least 2.6%. However, if the composition contains only the saturated diluents propane and butane, and methylacetylene, the percentage of methylacetylene should not be less than 52.5%, and the percentage of butane can vary from 2% to 4.8%. On the other hand, if the composition contains only non-saturated diluents, i.e. propylene with equal proportions of butene and butadiene, and propadiene, the quantity of propadiene must be at least 15% if there is 4% $C_4$ diluent; and 12.5% propadiene if there is 2.5% $C_4$ diluent.

In order to conform to the safety regulations described above, a mixture with an endothermic heat of formation of 20 KCal/mol cannot be manufactured using only saturated hydrocarbons as diluents. To the contrary, if one were to rely solely on saturated hydrocarbons as diluents and one wished to achieve an endothermic heat of formaion of 20 KCal./mol, it would be necessary to have the following composition:

| | |
|---|---|
| methylacetylene and propadiene | 66.5% |
| propane | 26.8% |
| butane | 6.7% |

If such a mixture were to be made from a mixture of $C_3$ hydrocarbons to which the butane is added, the $C_3$ hydrocarbon mixture would have the composition:

| | |
|---|---|
| propane | 28.73% |
| methylacetylene and propadiene | 71.27% |

However, such a $C_3$ hydrocarbon mixture is unstable and is dangerously explosive.

A few compositions of combustible mixtures based on methylacetylene or propadiene according to the invention are given below by way of example.

EXAMPLE 1:

An example of a composition of combustible mixtures near the lower limit of endothermic heat of formation per molar volume of 10 KCal is given below:

| | |
|---|---|
| methylacetylene and propadiene | 20.46% |
| propane | 5.90% |
| propylene | 57.18% |
| butene | 6.18% |
| butadiene | 8.71% |

This combustible mixture is made from a mixture of $C_3$ hydrocarbons to which the $C_4$ hydrocarbons have been added, the initial $C_3$ hydrocarbon mixture consisting of:

| | |
|---|---|
| propylene and propane | 75.51% |

-continued

| | |
|---|---|
| methylacetylene and propadiene | 24.49% |

The molar heat of formation of the resulting hydrocarbon mixture is 10.9 KCal.

EXAMPLE 2:

A combustible mixture for torches has the following composition (by volume):

| | |
|---|---|
| methylacetylene and propadiene (60/40) | 45 % |
| propene | 50 % |
| 1-butene | 5 % |

Its overall endothermic heat of formation, related to the molar volume, is 20.9 KCal.

EXAMPLE 3:

A combustible mixture for torches or burners has the following composition:

| | |
|---|---|
| methylacetylene | 20 % |
| propadiene | 25 % |
| propene | 50 % |
| 1-butene | 5 % |

Its endothermic heat of formation is 21.8 KCal, related to the molar volume.

EXAMPLE 4:

A combustible mixture has the following composition:

| | |
|---|---|
| methylacetylene | 9 % |
| propadiene | 31 % |
| propene | 54 % |
| 1-butene | 6 % |

Its exothermic heat of formation is 19.90 KCal.

EXAMPLE 5:

A combustible mixture has the following composition:

| | |
|---|---|
| methylacetylene | 9.5 % |
| propadiene | 34 % |
| propene | 50 % |
| butane | 5.5 % |

Its endothermic heat of formation is 19.80 KCal.

EXAMPLE 6:

A combustible mixture according to the invention has the following composition:

| | |
|---|---|
| methylacetylene | 20 % |
| propadiene | 25 % |
| propene | 40 % |
| propane | 10 % |
| 1-butene | 5 % |

Its endothermic heat of formation is 18.90 KCal.

EXAMPLE 7:

A combustible mixture for torches according to the invention has the following composition:

| | |
|---|---|
| methylacetylene | 10 % |
| propadiene | 34 % |
| propene | 50 % |
| 1-butene | 6 % |

Its endothermic heat of formation is 21.6 KCal.

EXAMPLE 8:

| | |
|---|---|
| methylacetylene and propadiene | 41.4 % |
| propane | 4.7 % |
| propene | 46.6 % |
| butane | 0.7 % |
| butene | 2.7 % |
| butadiene | 3.9 % |

Its exothermic heat of formation is 23 KCal/mol, manufactured from a $C_3$ hydrocarbon mixture of the following composition:

| | |
|---|---|
| methylacetylene and propadiene | 44.66 % |
| propane and propene | 55.34 % |

EXAMPLE 9:

| | |
|---|---|
| methylacetylene and propadiene | 43.4 % |
| propane | 4.2 % |
| propene | 40.7 % |
| butane | 1.1 % |
| butene | 4.4 % |

Its exothermic heat of formation is 20.4 KCal/mol. It is manufactured from a mixture of $C_3$ hydrocarbons of the following composition:

| | |
|---|---|
| methylacetylene and propadiene | 49.15 % |
| propane and propene | 50.85 % |

EXAMPLE 10:

| | |
|---|---|
| methylacetylene and propadiene (50 : 50) | 52.6 % |
| propane | 44.3 % |
| butane | 2.5 % |

Its exothermic heat of formation is - 11 KCal/mol. and the $C_3/C_4$ ratio is near 95/5.

EXAMPLE 11:

| | |
|---|---|
| methylacetylene and propadiene (50 : 50) | 54.0 % |
| propane | 32.2 % |
| butane | 13.8 % |

Its exothermic heat of formation is near - 11,5 KCal/mol and the $C_3/C_4$ ratio is near 70/30.

EXAMPLE 12:

| | |
|---|---|
| methylacetylene and propadiene (50 : 50) | 20 % |
| propene | 76 % |
| butene | 4 % |

Its exothermic heat of formation is near - 11 KCal/mol and the $C_3/C_4$ ratio is near 95/5.

EXAMPLE 13:

| | |
|---|---|
| methylacetylene and propadiene (50 : 50) | 21.0 % |
| propene | 55.3 % |
| butene | 23.7 % |

Its exothermic heat of formation is near - 11 KCal/mol and the $C_3/C_4$ ratio is near 70/30.

EXAMPLE 14:

| | |
|---|---|
| methylacetylene and propadiene (50 : 50) | 17 % |
| propene | 79 % |
| butene and butadiene (50 : 50) | 4 % |

Its exothermic heat of formation is near - 11 KCal/mol and the $C_3/C_4$ ratio is near 19.75.

EXAMPLE 15:

| | |
|---|---|
| methylacetylene and propadiene (50 : 50) | 20 % |
| propene | 76 % |
| butene and butadiene (50 : 50) | 4 % |

Its exothermic heat of formation is near - 12 KCal/mol, and the ratio $C_3/C_4$ is near 19.

EXAMPLE 16:

| | |
|---|---|
| methylacetylene and propadiene (50 : 50) | 48.4 % |
| propene | 49.0 % |
| butene and butadiene (50 : 50) | 2.6 % |

Its exothermic heat of formation is near - 23 KCal/mol, and the ratio $C_3/C_4$ is near 19.

It will be obvious to those skilled in the art that various changes may be made without departing from the scope of the invention and the invention is not to be considered limited to what is described in the specification.

the FIGURE shows a ternary diagram on which are indicated the proportions of methylacetylene - propadiene (M A P D) from 0 to 100, on line CB, the proportions of propane - propene on line CG and the proportions of butane - butene - butadiene on line GB.

Line AB corresponds to the ratio 45/55 between the $C_3$ of the diluent and the actif products (M A P D).

Lines CD and CD' correspond to the ratios 70/30 and 95/5 between the diluents $C_3$ and $C_4$.

Line EE' corresponds to a minimal endothermic heat of - 10 KCal.

The invention corresponds to the quadrilatere EE' FF'.

What is claimed is:

1. A stable combustible mixture for torches and burners consisting essentially of 1. 40–45% by volume based on the total combustible mixture consisting of methylacetylene, propadiene or a mixture thereof,
2. a $C_3$ hydrocarbon diluent consisting of propane, propylene or a mixture thereof; and
3. a $C_4$ hydrocarbon diluent consisting of a $C_4$ paraffinic hydrocarbon, a $C_4$ olefinic hydrocarbon or a mixture thereof;

the volume ratio of said methylacetylene, propadiene or mixture thereof to said $C_3$ hydrocarbon diluent being no greater than 55:45, and the volume ratio of said $C_3$ hydrocarbon diluent to said $C_4$ hydrocarbon diluent being from 70:30 to 95:5;

the endothermic heat of formation of said combustible mixture being at least 10KCal per molar volume.

2. The composition in accordance with claim 1 formed by mixing (1) said $C_4$ hydrocarbon diluent with (2) a preformed mixture of at least 50% $C_3$ hydrocarbon diluent with the remainder being methylacetylene, propadiene or a mixture thereof.

3. A stable combustible mixture in accordance with claim 1 wherein said $C_3$ hydrocarbon diluent constitutes at least 50% of the entire mixture.

4. A stable combustible mixture in accordance with claim 1 consisting essentially of

| | |
|---|---|
| methylacetylene and propadiene | 45 % |
| propene | 50 % |
| 1-butene | 5 %. |

5. A stable combustible mixture in accordance with claim 1 consisting essentially of

| | |
|---|---|
| methylacetylene | 20 % |
| propadiene | 25 % |
| propene | 50 % |
| 1-butene | 5 %. |

6. A stable combustible mixture in accordance with claim 1 consisting essentially of

| | |
|---|---|
| methylacetylene | 9 % |
| propadiene | 31 % |
| propene | 54 % |

-continued

| | |
|---|---|
| 1-butene | 6 %. |

7. A stable combustible mixture in accordance with claim 1 consisting essentially of

| | |
|---|---|
| methylacetylene | 9.5 % |
| propadiene | 34 % |
| propene | 50 % |
| butane | 5.5 %. |

8. A stable combustible mixture in accordance with claim 1 consisting essentially of

| | |
|---|---|
| methylacetylene | 20 % |
| propadiene | 25 % |
| propene | 40 % |
| propane | 10 % |
| 1-butene | 5 %. |

9. A stable combustible mixture in accordance with claim 1 consisting essentially of

| | |
|---|---|
| methylacetylene | 10 % |
| propadiene | 34 % |
| propene | 50 % |
| 1-butene | 6 %. |

10. A stable combustible mixture in accordance with claim 1 consisting essentially of

| | |
|---|---|
| methylacetylene and propadiene | 41.4% |
| propane | 4.7% |
| propene | 46.6% |
| butane | 0.7% |
| butene | 2.7% |
| butadiene | 3.9%. |

11. A stable combustible mixture in accordance with claim 1 consisting essentially of

| | |
|---|---|
| methylacetylene and propadiene | 43.4% |
| propane | 4.2% |
| propene | 40.7% |
| butane | 1.1% |
| butene | 4.4%. |

12. A stable combustible mixture for torches and burners formed essentially of at most about 45% by volume of methylacetylene and propadiene, diluted with a diluent which is itself formed of a mixture of at least one $C_3$ hydrocarbon and at least one $C_4$ hydrocarbon, wherein the amount of $C_3$ hydrocarbon diluent is between about 50% to 54% by volume and the amount of $C_4$ hydrocarbon diluent is between about 5–6% by volume.

* * * * *